US009902552B2

(12) United States Patent
Bilko

(10) Patent No.: US 9,902,552 B2
(45) Date of Patent: Feb. 27, 2018

(54) AEROSOL CAN

(75) Inventor: John Pawel Bilko, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 1062 days.

(21) Appl. No.: 14/238,361

(22) PCT Filed: Aug. 2, 2012

(86) PCT No.: PCT/EP2012/065124

§ 371 (c)(1),
(2), (4) Date: Jun. 18, 2014

(87) PCT Pub. No.: WO2013/017652

PCT Pub. Date: Feb. 7, 2013

(65) Prior Publication Data

US 2014/0326729 A1 Nov. 6, 2014

(30) Foreign Application Priority Data

Aug. 2, 2011 (GB) ..... 11176287.8

(51) Int. Cl.
*B65D 83/38* (2006.01)
*B65D 83/62* (2006.01)

(52) U.S. Cl.
CPC ..... *B65D 83/62* (2013.01); *B65D 83/38* (2013.01); *B65D 83/384* (2013.01); *B65D 2583/00* (2013.01)

(58) Field of Classification Search
CPC ..... B65D 83/62; B65D 83/38; B65D 83/384; B65D 2583/00
See application file for complete search history.

(56) References Cited

U.S. PATENT DOCUMENTS

2007/0272768 A1 11/2007 Williams et al.

FOREIGN PATENT DOCUMENTS

| | | | |
|---|---|---|---|
| EP | 0854827 | B1 | 1/2000 |
| EP | 1065156 | A1 | 1/2001 |
| GB | 2458222 | A | 9/2009 |
| WO | WO 02/072449 | A1 | 9/2002 |
| WO | WO 2011/024553 | A1 | 3/2011 |

*Primary Examiner* — Michael C Miggins
(74) *Attorney, Agent, or Firm* — Baker & Hostetler LLP

(57) ABSTRACT

The invention provides an aerosol container having an outer container body (10) with a plastic liner or bag (40) arranged therein, into which both product and propellant are filled, characterized in that the plastic liner or bag (40) has a multi-layer construction. The liner or bag (40) comprises a layer that is resistant to the product and a layer that prevents diffusion of the propellant out of the liner or bag (40). Further layers may also be incorporated to provide additional properties as required, for example an oxygen barrier, scavenging etc. Furthermore, one or more tie-layers, such as adhesive for example, may be provided to hold the separate layers together.

12 Claims, 2 Drawing Sheets

AEROSOL CAN

CROSS-REFERENCE TO RELATED APPLICATIONS

This application is the National Stage of International Application No. PCT/EP2012/065124 filed Aug. 2, 2012, which claims the benefit of EP application number 11176287.8, filed Aug. 2, 2011, the disclosures of which are incorporated herein by reference in their entirety.

TECHNICAL FIELD

The present invention relates to a pressurised container for storing and dispensing an aggressive product. More particularly, the present invention relates to an aerosol container adapted for use with aggressive products such as hair mousse for example.

BACKGROUND ART

Today, hair mousse is almost exclusively packaged in aluminium aerosol containers, coated internally with a high performance lacquer of PAI (polyamide-imide) chemistry. Under REACH regulations this lacquer chemistry has been classified as CMR-2 (CMR—carcinogenic, mutagenic, toxic to reproduction and category 2—strongly suspected to trigger or increase the frequency of CMR effects). There exists the possibility that the use of this material could eventually be banned under the REACH regulations. (REACH is a European Union regulation concerning the Registration, Evaluation, Authorisation & restriction of Chemicals.) Since December 2010, such material has been classified as R61 (may cause harm to the unborn child), R37/36/38 (irritating to eyes, respiratory system and skin) and must be labelled as toxic. Therefore, it is socially & environmentally responsible to avoid using such a classification of chemical, wherever possible.

WO 02/072449 A (GLAXO GROUP) Jul. 9, 2002 describes a canister for use in metered dose inhalers formed from a laminate material composed of a metal and a strengthening material. The laminate is described as providing equivalent or greater strength than ticker walled aluminium containers. However, this is different to the problem addressed by the present invention, where the container is required to store and dispense an aggressive product requiring a high performance, corrosion resistant lacquer.

U.S. 2007272768 A Nov. 29, 2007 discloses a container for pressurised materials having a multi-layer construction, particularly water-based adhesives. The inner layer is described as being resistant to corrosion from contact with water. However, this document does not discuss aggressive personal care or household products and rather is focussed on adhesives that must not be exposed to air before being expelled from the container.

EP 0854827 B (PROCTER & GAMBLE) Mar. 1, 2000 discloses an aerosol can, filled with an acidic detergent composition, and having a plastic liner to provide protection for the can. According to this patent, the liner/container assembly is filled with an aggressive product (for example an acidic detergent composition) and an aerosol propellant. The plastic liner is preferably made from a polyolefin material, more preferably high density polyethylene or polypropylene. However, this patent also notes that hydrocarbon propellants will diffuse through polyolefin materials with time.

The inventors have appreciated the benefit of using a separate liner to protect an outer aerosol container as described in this patent. In particular, the inventors noted that as long as the liner is compatible with the product or composition and propellant, the product/propellant combination may be stored within the liner, without worrying about the adverse effect of the product/propellant combination on the outer aerosol container. The use of a liner in this way provides a possible solution to the problems associated with using a high performance, but potentially toxic lacquer to coat the inside of a metal aerosol can when packaging aggressive products. Furthermore, provision of a liner allows the outer aerosol container to be produced using a wider range of materials and techniques e.g. conventional steel, aluminium or plastic containers may be provided, manufactured using known 2-piece, 3-piece or impact extrusion techniques. However, diffusion of the propellant through the liner or bag over time will gradually reduce the effectiveness of the aerosol container in dispensing the product and is unsatisfactory for a user of the aerosol can.

SUMMARY OF INVENTION

Accordingly, the inventor has proposed an aerosol container having an outer container body with a separate plastic liner or bag arranged therein, into which both product and propellant are filled, characterised in that the plastic liner or bag has a multi-layer construction. The liner or bag comprises a layer that is resistant to the product and a layer that prevents diffusion of the propellant out of the liner or bag. Further layers may also be incorporated to provide additional properties as required, for example an oxygen barrier, scavenging etc. Furthermore, one or more tie-layers, such as adhesive for example, may be provided to hold the separate layers together.

In particular, the inventors propose a multi-layer bag into which both propellant and hair mouse formulation are filled. The bag is made up of a nylon outer layer (20%)—nylon being chosen for it's barrier properties to LPG (Liquid Petroleum Gas) i.e. to keep the propellant in the bag with the formulation, an adhesive layer (5%)—chosen to bind the outer and inner layers together and not allow delamination which would affect bag performance, and a low density polyethylene (LDPE) inner layer (75%)—chosen for it's barrier properties to the formulation i.e. to keep the formulation inside the bag from leaching out and attacking the can. The percentages of nylon and LDPE were chosen to provide a bag which is most cost effective (LDPE being much cheaper than nylon), yet flexible enough to insert into the metal can body, through the valve aperture, without the need for conditioning and which is able to expand gently under pressure (i.e. when filled) to fit inside the can body as closely as possible.

The liner or bag may be produced from a sheet of multilayer material, which is sealed together around its periphery, apart from an open portion, which is left unsealed to provide an aperture for filling. A disadvantage of this design is that once the liner or bag is filled with product and propellant, it will experience internal pressure, which may result in breaks in the sealed periphery, causing the seams of the liner or bag to leak. This may be mitigated to some extent by the external support provided by the outer container body, but any leaks will obviously defeat the object of the invention as the product/propellant may escape the liner or bag and come into direct contact with the outer container.

Preferably, the bag or liner is of unitary construction such as that produced by extrusion blow moulding or injection blow moulding for example.

The liner or bag according to the invention has the advantage of strength under pressure from the inside (rather than the outside) versus the known bag-on-valve (BOV) design. It is strongly suspected that the current bag-on-valve (BOV) technology would be unfit for this purpose, as constraining the necessary internal pressure in the laminate bag would be too great for the heat seal between the bag and the valve stem.

BRIEF DESCRIPTION OF DRAWINGS

The present invention will now be described, by way of example only, with reference to the accompanying drawings. In which.

DESCRIPTION OF EMBODIMENTS

Figure 1:
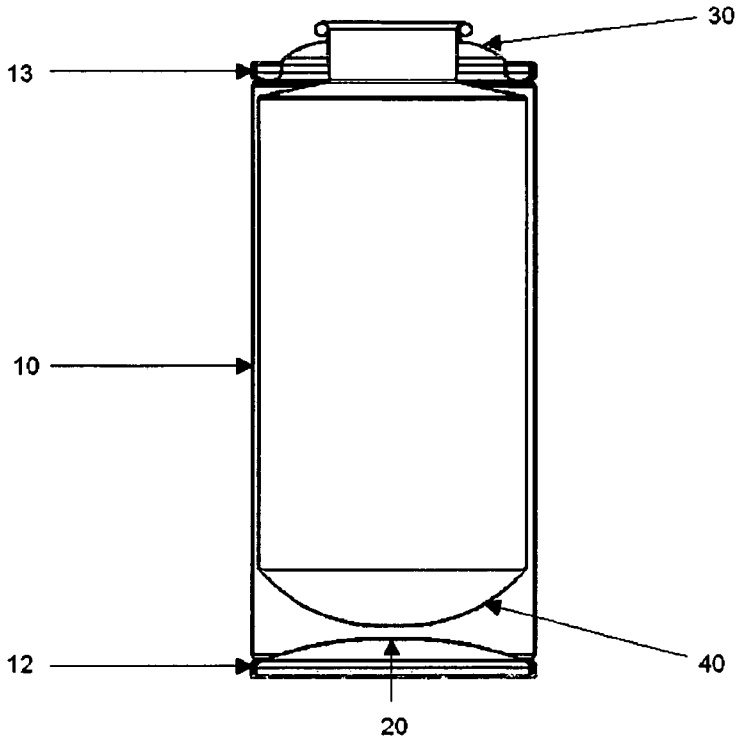
FIG. 1 shows a side cross-sectional view of a container body including a bag according to the invention, suitable for supply to a filler.

Referring to FIG. 1, an unfilled aerosol can body/bag combination according to the invention comprises a body 10 and a bottom 20 joined together by a double seam 12, a top 30 joined to the body 10 by another double seam 13 (as produced in a conventional 3-piece can manufacturing process) and a bag or liner 40, which is inserted into the can 10, 20, 30 using conventional techniques. This provides the "intermediate product", which is sold to a filler, for filling with a product.

The filler will then fill the liner or bag 40 with product and propellant and insert a valve assembly to seal the finished aerosol container, before selling the filled aerosol to a consumer. The filler may fill the liner or bag 40 with the product before fitting the valve and then fill the propellant through the valve to pressurise the container or the filler may choose to fit the valve onto the container and then fill both the product and the propellant through the valve.

Figure 2:
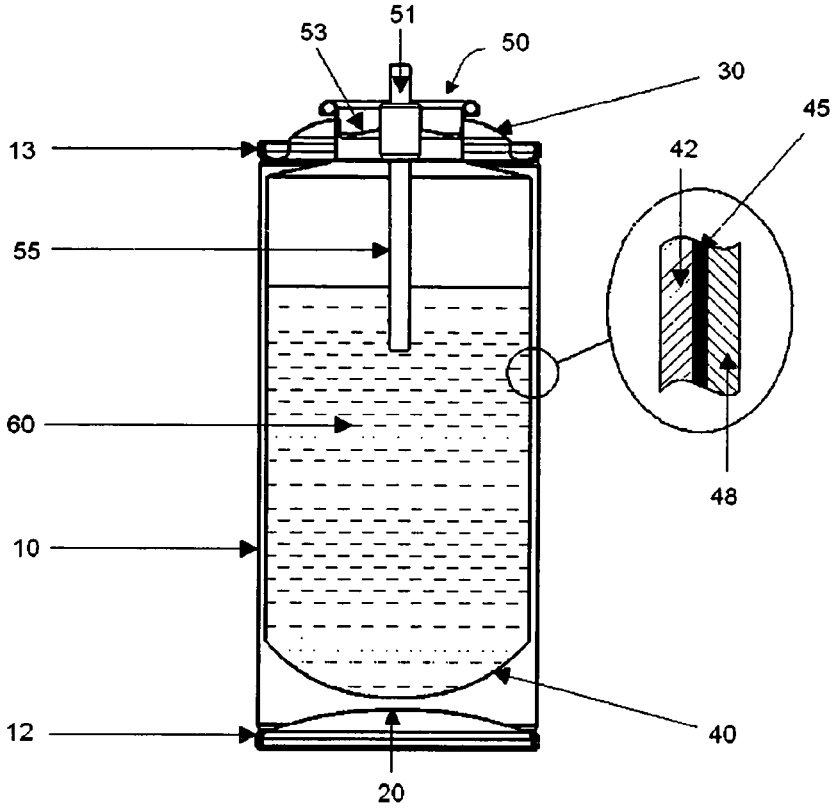
FIG. 2 shows a side cross-sectional view of an aerosol container according to the invention, as supplied to a user. This drawing also includes a detail view illustrating the structure of the multi-layer bag.

FIG. 2 shows the finished, filled aerosol can as would be sold to the consumer. As described in relation to FIG. 1 the aerosol can has a container body 10, a top 30 and a bottom 20 joined together by conventional double seaming techniques to provide double seams 12 and 13. A valve assembly 50 including a valve 51 having a dip tube 55 is mounted to a valve cup 53. The valve assembly 50 is joined to the aperture in the top 30 using conventional techniques, sealing the bag 40 inside the container 10, 20, 30. As described above, a product/propellant mixture 60 is filled into the bag 40 (either separately or together and before or after installation of the valve assembly 50) and the finished aerosol can is sold to a consumer.

Upon filling the bag 40 with the product and/or propellant 60, the weight of the product may cause the bag 40 to make contact with the bottom 20. Also, upon pressurising the bag 40 with the propellant, the bag 40 may expand and make contact with the body 10. The bag 40 is designed to be sufficiently flexible to accommodate this expansion.

Referring to the detailed section shown in FIG. 2, the bag 40 has a multi-layer construction including an inner layer 42, chosen to be resistant to the product, an outer layer 48, chosen to prevent diffusion of the propellant out of the bag, and a tie-layer 45 (such as adhesive), which holds layers 43 and 48 together. Preferably the inner layer 42 (75%) is low-density polyethylene (LDPE), the outer layer 48 (20%) is nylon and the tie-layer 45 is adhesive.

The invention claimed is:

1. An aerosol container and product package comprising:
- a container body;
- a liner or bag arranged in the container body, each of a product and a propellant are disposed within the liner or bag,
- the liner or bag having multiple layers including a layer that is resistant to the product and a layer that prevents diffusion of the propellant out of the liner or bag.

2. An aerosol container according to claim 1, wherein at least one of the layers includes nylon.

3. An aerosol container according to claim 1, wherein the liner or bag comprises a unitary construction.

4. An aerosol container according to claim 1, wherein the multiple layers of the liner or bag includes a layer that is resistant to the product and a layer that prevents diffusion of the propellant out of the liner or bag.

5. An aerosol container according to claim 4, wherein the liner or bag also includes one of more tie-layers to hold the multiple layers together.

6. An aerosol container according to claim 1, wherein at least one of the layers includes polyethylene.

7. An aerosol container according to claim 6, wherein the polyethylene is low-density polyethylene.

8. A multi-layer liner for an aerosol container adapted to receive both a product and a propellant within, wherein the liner comprises a layer that is resistant to the product and a layer that prevents diffusion of the propellant out of the liner.

9. A multi-layer liner according to claim 8, wherein the liner is manufactured from two layers of material heat-sealed together around their periphery, leaving an open portion for filling.

10. A multi-layer liner according to claim 8, wherein the liner comprises a unitary construction.

11. A multi-layer liner for an aerosol container, comprising the following layers:
- a 20% nylon layer
- a 5% tie layer, and
- a 75% low-density polyethylene layer.

12. An aerosol container comprising:
- a container body;
- a liner or bag arranged in the container body, the liner or bag adapted for receiving both a product and a propellant within,
- the separate liner or bag having multiple layers including a layer that is resistant to the product and a layer that prevents diffusion of the propellant out of the liner or bag.

* * * * *